US005531172A

United States Patent [19]

Kojima et al.

[11] Patent Number: 5,531,172

[45] Date of Patent: Jul. 2, 1996

[54] AUXILIARY BED DEVICE FOR OVERLOCK MACHINE

[75] Inventors: Shinji Kojima; Koichi Nakayama, both of Utsunomiya, Japan

[73] Assignee: The Singer Company N.V., Curaco, Netherlands

[21] Appl. No.: 356,755

[22] Filed: Dec. 15, 1994

[30] Foreign Application Priority Data

Dec. 20, 1993 [JP] Japan ..... 5-072830

[51] Int. Cl.[6] ..... D05B 73/10

[52] U.S. Cl. ..... 112/260

[58] Field of Search ..... 112/260, 217.1; 108/143, 59, 64; 312/334

[56] References Cited

U.S. PATENT DOCUMENTS

| | | | |
|---|---|---|---|
| 2,708,292 | 5/1955 | Budai | 108/64 X |
| 3,344,762 | 10/1967 | Szostak et al. | 112/260 |
| 4,165,908 | 8/1979 | Cooper et al. | 108/64 X |
| 4,220,103 | 9/1980 | Kasahara et al. | 112/260 |
| 4,224,887 | 9/1980 | Meier | 112/260 |
| 4,426,944 | 1/1984 | Bianchi | 112/260 |

FOREIGN PATENT DOCUMENTS

| | | | |
|---|---|---|---|
| 84361 | 7/1983 | European Pat. Off. | 112/260 |
| 104954 | 8/1979 | Japan | 112/260 |

*Primary Examiner*—Ismael Izaguirre
*Attorney, Agent, or Firm*—McCormick, Paulding & Huber

[57] ABSTRACT

There is provided an auxiliary bed device for an overlock machine in which sewing of cylindrical workpieces, such as cuffs and bottom edges of pants legs, and pouches as well as flat ones can be performed only by manually sliding the auxiliary bed against the free arm, thereby a change-over of the auxiliary bed being considerably efficient when sewing of cylindrical and flat workpieces are carried out alternately. The auxiliary bed 4 located at a front side of the free arm 3 is equipped to the main sewing machine bed 1 longitudinally slidably and detachably by engaging thereof by engaging part S1, *6a* and a fitting part *4d*, *4c*, thereby the workpiece holding area being formed together with respective upper surfaces of the main sewing machine bed 1, the free arm 3 and the auxiliary bed 4 in a situation where said auxiliary bed 4 is moved backward, while a given space S2 for sewing being formed between a back side *4g* of said auxiliary bed 4 and a front side *3a* of said free arm 3 in a situation where said auxiliary bed 4 is moved forward.

3 Claims, 4 Drawing Sheets

AUXILIARY BED DEVICE FOR OVERLOCK MACHINE

BACKGROUND OF THE INVENTION

1. Field of the Invention

This invention relates to an auxiliary bed device for a free arm type overlock machine.

2. Prior Art

Overlock machines form overlock stitches by cooperative operations of a vertically movable needle holding a needle thread, an upper looper holding an upper looper thread passed through a thread hole at the tip end portion thereof operating across a workpiece feed direction and a lower looper holding a lower looper thread. A free arm type overlock machine, in general, has a free arm and an auxiliary bed (auxiliary table), thereby only the free arm being used to sew cylindrical workpieces, such as cuffs and bottom edges of pants legs, and pouches, while the auxiliary bed being used, in combination with the free arm, to sew ordinary flat workpieces. The free arm type overlock machine is well adapted to sew cylindrical workpieces and pouches, however, because of a narrow holding area thereof, it should be necessary to attach the auxiliary bed to sew ordinary flat ones so as to widen the holding area.

Thus, in a case of such a conventional free arm type overlock machine in which the auxiliary bed is attached and detached depending on a kind of workpieces, although it has been known to allow the auxiliary bed to be detachable to the free arm to increase the durability and reliability, an attaching or detaching operation of the auxiliary bed is required every when the kind of workpieces is changed, which is considerably troublesome.

SUMMARY OF THE INVENTION

This invention has been made in view of the aforementioned technical problem in the prior art. According to the first aspect of the invention, there is provided an auxiliary bed device for an overlock machine provided with a free arm 3 at a side of a back portion of a main sewing machine bed 1, which forms a workpiece holding area on an upper surface thereof and is joined to a throat plate 2, characterized in that an auxiliary bed 4 located at a front side of the free arm 3 is equipped to the main sewing machine bed 1 longitudinally slidably and detachably by engaging thereof by means of an engaging part S1, 6*a* and a fitting part 4*d*, 4*c*, thereby the workpiece holding area being formed with respective upper surfaces of the main sewing machine bed 1, the free arm 3 and the auxiliary bed 4 in a situation where said auxiliary bed 4 is moved backward, while a given space S2 for sewing being formed between a back side 4*g* of said auxiliary bed 4 and a front side 3*a* of said free arm 3 in a situation where said auxiliary bed 4 is moved forward.

According to the second aspect of this invention, there is provided an auxiliary bed device for an overlock machine of the first aspect, characterized in that the engaging part S1, 6*a* is divided by means of a guide plate 6 which is fixed to the main sewing machine bed 1 keeping a given accepting slit S1 from a side wall surface la of the main sewing machine bed 1 and the fitting part 4*d*, 4*c* is formed by means of a projecting portion 4*d* to provide a guide groove portion 4*c* under a protruding portion 4*f* horizontally extending from an upper end of the other side of the auxiliary bed 4, thereby accepting a guide portion 6*a* of an upper end of the guide plate 6 in said guide groove portion 4*c* and also accepting the projecting portion 4*d* in said accepting slit S1.

According to the third aspect of this invention, there is provided an auxiliary bed device for an overlock machine of the first or second aspect, characterized in that a flanged projecting portion 8, 9 or 9' is formed at one of opposite points on a side surface of the guide plate 6 and the other side wall 4*b* of the auxiliary bed 4 and an opening hole 10 or 10' having a longitudinally extended long hole portion 10*a* or 10'*a* is formed at other one of the points so as to guide a longitudinal movement of the auxiliary bed 4 by engaging the flanged projecting portion 8, 9 or 9' with the long hole portion 10*a* or 10'*a*.

According to the fourth aspect of the invention, there is provided an auxiliary bed device for an overlock machine of the first, second or third aspect, characterized in that the box-shaped auxiliary bed 4 has an opening 4*e* on an upper portion thereof and is provided with an openable lid member 4*a* over said opening 4*e*.

According to the first aspect of this invention, when the auxiliary bed 4 is equipped to the main sewing machine bed 1 by engaging the fitting part 4*d*, 4*c* with the engaging part S1, 6*a* and the auxiliary bed 4 is held to move backward in such a situation, the back side 4*g* of the auxiliary bed 4 comes close to the front surface 3*a* of the free arm 3 allowing respective upper surfaces of the main sewing machine bed 1, the throat plate 2, the free arm 3 and the auxiliary bed 4 to form a plane holding area, thereby sewing of flat workpieces being done conveniently. On the other hand, when the auxiliary bed 4 is moved forward sufficiently, a given space S2 for sewing results in between the back side 4*g* of the auxiliary bed 4 and the front surface 3*a* of the free arm 3, thereby sewing of cylindrical workpieces, such as cuffs and bottom edges of pants legs, and pouches being done conveniently.

If the auxiliary bed 4 is completely demounted from the main sewing machine bed 1 by releasing the engagement of the fitting part 4*d*, 4*c* with the engaging part S1, 6*a*, the sewing machine is used exclusively for sewing cylindrical workpieces, such as cuffs and bottom edges of pants legs, and pouches.

According to the second aspect of this invention, it is possible that the guide portion 6*a* of the upper end of the guide plate 6 is accepted by the guide groove portion 4*c* of the auxiliary bed 4 and further the projecting portion 4*d* of the auxiliary bed 4 is accepted by the accepting slit S1 of the main sewing machine bed 1 so as to equip the auxiliary bed 4 to the main sewing machine 1 by engaging with the engaging part S1, 6*a* and the fitting part 4*d*, 4*c*.

According to the third aspect of this invention, the longitudinal movement of the auxiliary bed 4 is guided between a side of the guide plate 6 and the side wall 4*b* of the auxiliary bed 4 in a situation where the flanged projecting portion 8, 9 or 9' is engaged with the longitudinally extending long hole portion 10*a* or 10'*a*. At the same time, a flange portion of the flanged projecting portion 8, 9 or 9' is engaged with a periphery of the long hole portion 10 or 10'*a* to guide the movement of the auxiliary bed 4. The forward movement of the auxiliary movement can be controlled by contacting the flanged projecting portion 8, 9 or 9' to a back end portion of the long hole portion 10*a* or 10'*a*.

According to the forth aspect of this invention, while the box-shaped auxiliary bed 4 has an opening 4*e* on an upper part thereof and is provided with an openable lid member 4*a* over said opening 4*e*, it is possible to store sewing machine accessories in the auxiliary bed 4.

PREFERRED EMBODIMENT OF THE INVENTION

An embodiment of this invention will be described with reference to drawings.

FIGS. 1 to 9 show an auxiliary bed device for an overlock machine according to an embodiment of this invention. In the figure, denoted at 1 is a main sewing machine bed of the overlock machine, to which a throat plate 2, a free arm 3 and a sewing machine arm (not shown) are attached by a known means. The free arm 3 is connected to the throat plate 2 attached to a side of the back portion of the sewing machine and has a box-shaped or square cylinder-shaped which covers a lower looper (not shown) and is detachable, thereby allowing thereof to form a holding area to hold workpieces (not shown) being formed by joining together with respective upper surfaces of the throat plate 2 connected to the main sewing machine bed 1 and an auxiliary bed 4 as will be described below. The back portion of the sewing machine is located right upward in FIG. 2 and forward in a workpiece feeding direction.

Figure 4:
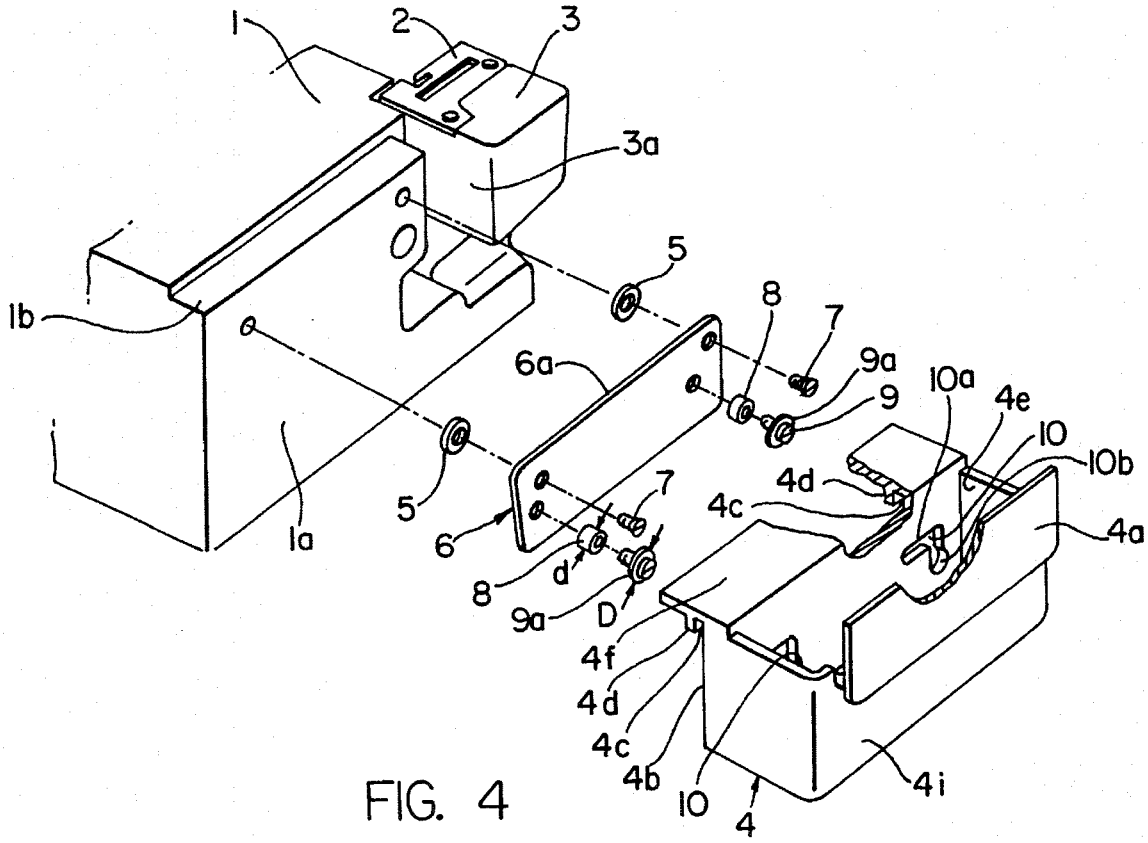
FIG. 4 is an exploded perspective view of a partially cut auxiliary bed device in FIG. 1.
Figure 7:
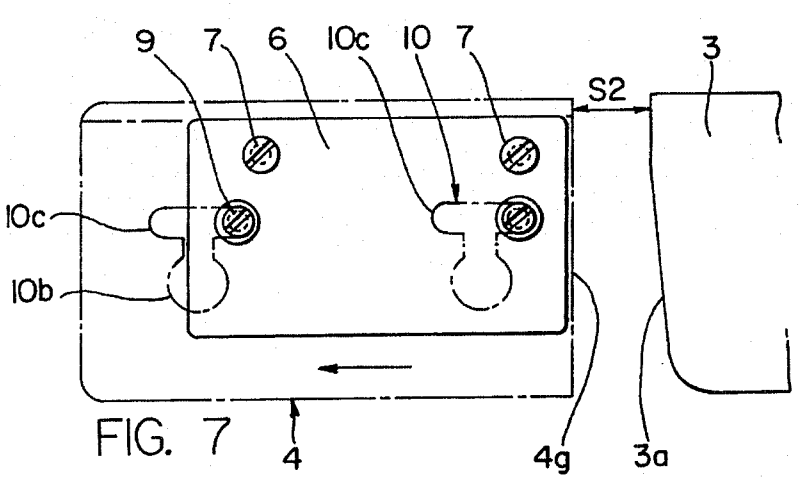
FIG. 7 is a functional illustration of the auxiliary bed device in FIG. 1.
Figure 6:
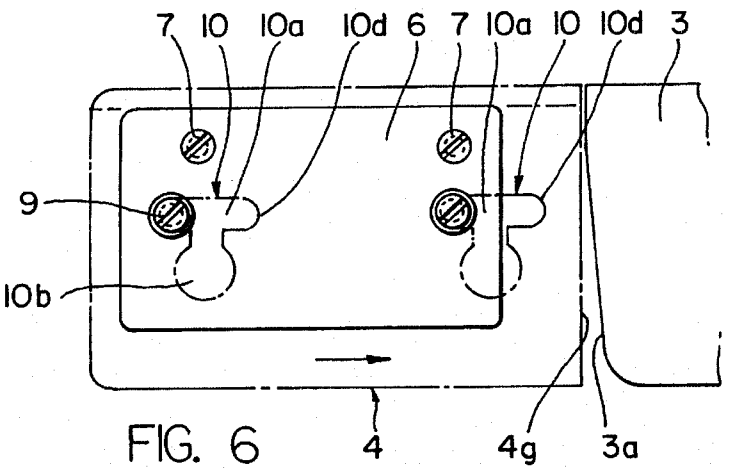
FIG. 6 is a functional illustration of the auxiliary bed device in FIG. 1.

As shown in FIG. 4, an auxiliary bed 4 has a box-shaped auxiliary bed body **4*i* with an opening 4*e* over an upper portion thereof, where an openable lid member 4*a* is provided. A horizontally extended protruding portion 4*f* is formed at an upper end of the other side wall of the auxiliary bed body 4*i*, while a longitudinally extended fitting part, i.e. a projecting portion 4*d* is formed at a given interval between the protruding portion and the upper portion of the other side surface 4*b* of the auxiliary bed body 4*i* so as to provide a guide groove portion 4*c*. Further, as shown in FIG. 4, a pair of reverse L shaped opening holes 10 having a longitudinally extended long hole portion 10*a* and a larger hole portion 10*b* extending downward from a back end portion of the long hole portion 10*a* and locating at a bottom thereof, are formed in on the other side wall of the auxiliary bed body 4*i*. Each of the opening hole 10 may only have the longitudinally extended long hole portion 10*a* and the larger hole portion 10*b* extending downward from a part of the long hole portion 10*a* to the bottom and may provide a T-shape as shown in FIGS. 6 and 7. The present auxiliary bed 4 may be made of plastic, accessories of the sewing machine being stored in the auxiliary bed body 4*i***.

Figure 3:
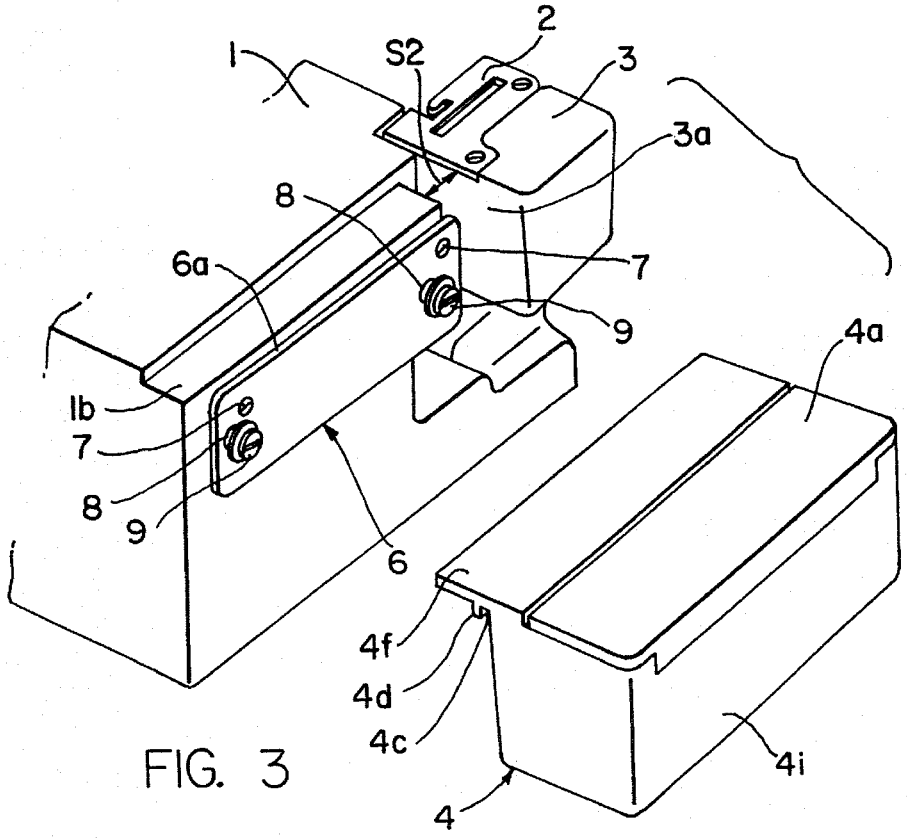
FIG. 3 is a perspective view of the auxiliary bed device in FIG. 1 where the auxiliary bed is demounted.
Figure 5:
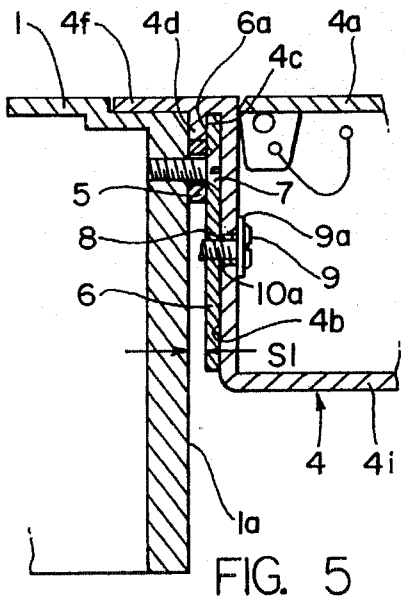
FIG. 5 is a sectional view of a main part of the auxiliary bed device in FIG. 1.

On the other hand, a slightly lower step portion **1*b* is formed on an end portion of the upper surface of the main sewing machine bed 1, as shown in FIGS. 3 and 4. Further, a guide plate 6 is fixed to a side wall surface 1*a* by means of a setscrew 7 through a spacing member 5 consisting of a washer as shown in FIG. 4, thereby forming an accepting slit S1 as an engaging part between the side wall surface 1*a* and the guide plate 6 as shown in FIG. 5. An upper end portion above the setscrew 7 of the guide plate 6 forms itself a guide portion 6*a*. In addition, a pair of flanged setscrews 9 having a circular flange 9*a* of larger diameter D is provided horizontally below the setscrew 7 together with a shorter cylindrical spacer 8 of smaller diameter d passing therethrough. A flanged projecting portion is formed by the spacer 8 and the flanged setscrew 9. Back sides of the step portion 1*b* of the main sewing machine bed 1 and the guide plate 6 are kept apart from a front surface 3*a* of the free arm 3 enough to provide a given space S2 for sewing as shown in FIG. 3**.

A pair of the flanges **9*a* has sufficient diameter and thickness to pass through only the larger hole portion 10*b* of a pair of the opening holes 10, while a pair of spacers 8 moves from the larger hole portion 10*b* to the long hole portion 10*a* and then makes it possible to relatively move in the long hole portion 10*a*. Further, in a situation where a pair of the spacers 8 is engaged in the long hole portion 10*a* as shown in FIG. 5, the guide portion 6*a* of the guide plate 6 is accepted in the guide groove 4*c* of the auxiliary bed 4 to engage thereof slidably, the projecting portion 4*d* is inserted in the accepting slit S1 to engage thereof slidably and, in addition, the horizontally protruding portion 4*f* of the auxiliary bed 4 is held slidably on the step portion 1*b* of the main machine bed 1 to join the upper surface of the auxiliary bed 4 including that of the horizontally protruding portion 4*f* to the upper surface of the main sewing machine bed 1 all together. Needless to say, the back portion of the auxiliary bed 4 does not interfere the front portion of the free arm 3 when a pair of the flanges 9*a* is passed through a pair of the larger hole portion 10*b* of the opening hole 10**.

Figure 1:
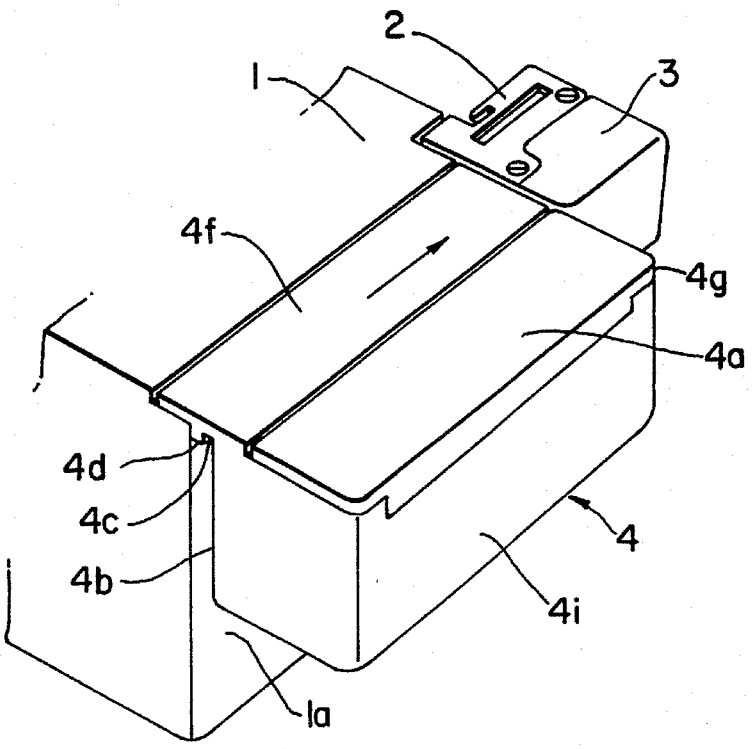
FIG. 1 is a perspective view of an auxiliary bed device for an overlock machine where an auxiliary bed and a free arm are joined according to an embodiment of this invention.

When the auxiliary bed 4 is manually slid backward as in such a situation where the auxiliary bed 4 is equipped to the main sewing machine bed 1 as shown in FIGS. 1 and 6, the upper portion of the back surface **4*g* thereof is closely contacted to the upper portion of the front surface 3*a* of the free arm, thereby allowing respective upper surfaces of the main sewing machine bed 1, the throat plate 2, the free arm 3 and the auxiliary bed 4 to form the flat holding area which enables to sew flat workpieces. In this situation, the guide groove portion 4*c* of the auxiliary bed 4 is guided to the guide portion 6*a* of the guide plate 6 to slide thereof, the projecting portion 4*d* is guided to the accepting slit S1 to slide thereof, the horizontally protruding portion 4*f* of the auxiliary bed 4 is slid on the step portion 1*b* of the main sewing machine bed 1 and the other side surface 4*b* of the auxiliary bed 4 is guided to the side surface of the guide plate 6. Further, the spacer 8 is relatively moved in the long hole portion 10*a* to engage the flange 9*a* of the flanged setscrew 9 periphery of the long hole portion 10*a*, thereby a slide of the auxiliary bed 4 being guided. The movement of the auxiliary bed 4 is thus performed stably. A front end portion 10*c* of the long hole portion 10*a* is allowed not to interfere the spacer 8 in a situation where the upper portion of the back surface 4*g* of the auxiliary bed 4 is closely contacted to that of the front surface 3*a* of the free arm 3**.

Figure 2:
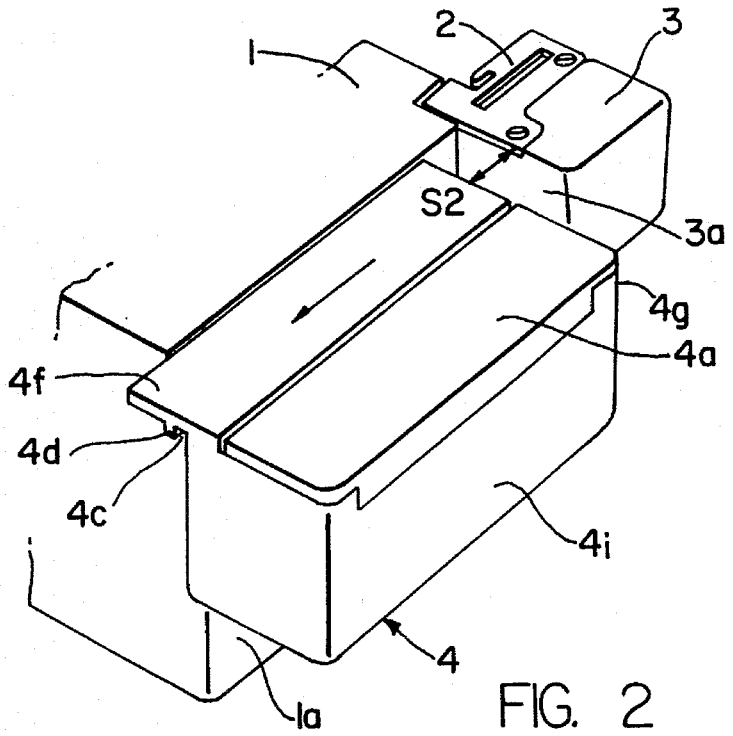
FIG. 2 is a perspective view of the auxiliary bed device in FIG. 1 where the auxiliary bed and the free arm are separated.

Then, when the auxiliary bed 4 is slid forward sufficiently as shown in FIGS. 2 and 7, the back surface **4*g* of the auxiliary bed 4 leaves a given space S2 for sewing against the front surface 3***a* of the free arm 3, which can be used for sewing cylindrical workpieces, such as cuffs and bottom edges of pants legs, and pouches. Such a forward movement of the auxiliary bed 4 is controlled by contacting a back end portion of the long hole portion 10*a* with the spacer 8.

The main sewing machine bed 1 may be used exclusively for sewing cylindrical workpieces, such as cuffs and bottom edges of pants legs, and pouches if the auxiliary bed 4 is demounted therefrom completely.

Figure 8:
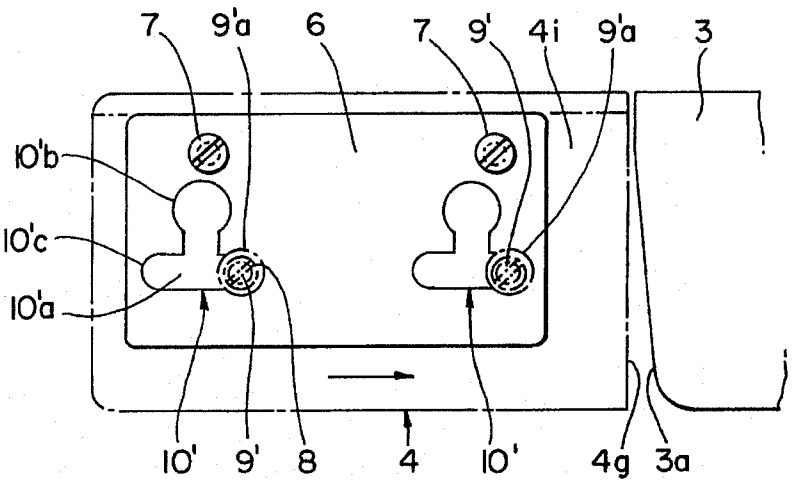
FIG. 8 is an illustration of the auxiliary bed device in FIG. 1 showing an another structural embodiment of a flanged protruding portion.
Figure 9:
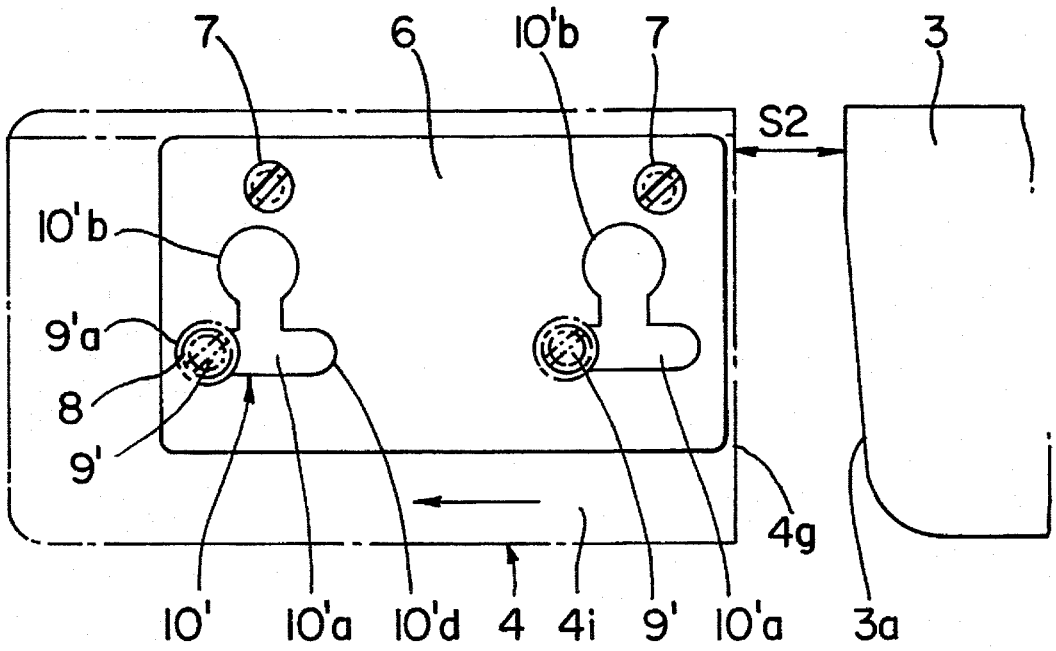
FIG. 9 a functional illustration of the auxiliary bed device in FIG. 8.

In FIGS. 8 and 9, there is shown a structural embodiment in which a reverse T shaped opening hole 10' is formed in the guide plate 6 and a flanged projecting portion consisting of a flanged setscrew 9' which has a shorter cylindrical spacer 8 and a circular flange 9'*a* is formed on the other side surface of the auxiliary bed 4. More precisely, the reverse T shaped opening hole 10' which has a longitudinally extended long hole portion 10'*a* and a larger hole portion 10'*b*, extending upward from a central portion of the long hole portion 10'*a* and locating at an upper end, is formed below the setscrew 7 of the guide plate 6. On the other hand, a pair of the setscrews 9' having a circular flange 9'*a* of larger diameter D is provided horizontally below the setscrew 7 together with a shorter cylindrical spacer 8 of smaller diameter d passing therethrough.

A pair of the flanges 9'*a* has sufficient diameter and thickness to pass through the larger hole portion 10'*b* of a pair of the opening hole 10', while a pair of spacers 8 moves from the larger hole portion 10'*b* to the long hole portion 10'*a* and then makes it possible to longitudinally and relatively move in the long hole portion 10'*a*. Similarly, in a situation of the present structural embodiment where a pair of the spacers 8 is engaged in the long hole portion 10'*a*, the guide portion 6*a* of the guide plate 6 is accepted in the guide groove 4*c* of the auxiliary bed 4 to engage thereof slidably, the projecting portion 4*d* is inserted in the accepting slit S1 to engage thereof slidably and, in addition, the horizontally protruding portion 4*f* of the auxiliary bed 4 is held slidably on the step portion 1*b* of the main machine bed 1 to join the upper surface of the horizontally protruding portion 4*f* to that of the main sewing machine bed 1. Accordingly, a similar function as described in the former embodiment can be achieved in the present structural embodiment.

As understood from the above description, according to this invention, it is possible to sew cylindrical workpieces, such as cuffs and bottom edges of pants legs, and pouches as well as flat ones only by manually sliding the auxiliary bed against the free arm, thereby a change-over of the auxiliary bed is considerably efficient when these sewing are carried out alternately. Further, the present auxiliary bed device has a simple structure, superior durability and reliability, a cheaper production cost and easier productivity.

What is claimed is:

1. An overlock machine including a main bed, a free arm horizontally extending from a side wall of the main bed, and a throat plate secured to the free arm, comprising:

a guide plate secured to the side wall of the main bed, said guide plate having at least one flanged projecting portion extending outwardly away from said main bed; and an auxiliary bed comprising a horizontal upper surface, at least one side wall that vertically extends downward from said upper surface, and a fitting part horizontally extending from said side wall, said side wall of said auxiliary bed having at least one longitudinally disposed elongated slot adapted to receive said flanged projecting portion for detachably and slidably connecting said auxiliary bed to said guide plate, said fitting part slidably engaging the guide plate for longitudinally guiding the movement of the auxiliary bed parallel to the side wall of the main bed between a first position and a second position; said auxiliary bed being contiguous to said free arm at said first position to provide a workpiece holding area defined by upper surfaces of the main bed, the free arm, the throat plate and said auxiliary bed; said auxiliary bed being spaced from said free arm at said second position.

2. An overlock machine of claim 1, characterized in that the fitting part having a downwardly extending projecting portion laterally-spaced from said side wall of said auxiliary bed that defines a guide groove portion adapted to slidably engage an upper edge portion of the guide plate; and said guide plate being laterally-spaced from the side wall of the main bed by a predetermined distance that defines an accepting slit adapted to slidably engage said projecting portion.

3. An overlock machine of claim 1, characterized in that the auxiliary bed is box-shaped and has an opening on an upper portion thereof and is provided with an openable lid member over said opening.

* * * * *

UNITED STATES PATENT AND TRADEMARK OFFICE

CERTIFICATE OF CORRECTION

PATENT NO. : 5,531,172

DATED : July 2, 1996

INVENTOR(S) : Shinji Kojima and Koichi Nakayama

It is certified that error appears in the above-indentified patent and that said Letters Patent is hereby corrected as shown below:

On the title page, item [73]:

Assignee:

Please delete "Netherlands: and substitute --Netherlands Antilles--.

Signed and Sealed this

Eleventh Day of March, 1997

*Attest:*

*Attesting Officer*

BRUCE LEHMAN

*Commissioner of Patents and Trademarks*